United States Patent [19]

Pedragosa

[11] Patent Number: 4,742,932

[45] Date of Patent: May 10, 1988

[54] METHOD OF MANUFACTURING HOLLOW SHEET METAL CONTAINERS AND CONTAINERS PRODUCED THEREBY

[76] Inventor: Pedro P. Pedragosa, Calle Pedro No. 26, Santa Coloma De Gramanet (Porv. Barcelona), Spain

[21] Appl. No.: 701,172

[22] Filed: Feb. 13, 1985

[30] Foreign Application Priority Data

Feb. 15, 1984 [ES] Spain ..... 530.099
Sep. 7, 1984 [ES] Spain ..... 281.496

[51] Int. Cl.[4] ..... B65D 6/34

[52] U.S. Cl. ..... 220/67; 220/74; 220/76

[58] Field of Search ..... 220/67, 66, 68, 74, 220/75, 76, 79

[56] References Cited

U.S. PATENT DOCUMENTS

| | | | |
|---|---|---|---|
| 2,384,810 | 9/1945 | Calleson et al. . | |
| 3,353,705 | 11/1967 | Kane | 220/67 |
| 3,558,362 | 1/1971 | McHenry | 220/67 |
| 3,737,077 | 6/1973 | Bruce et al. | 220/67 |
| 3,902,630 | 9/1975 | Knize . | |
| 3,912,110 | 10/1975 | Hammes | 220/67 |
| 4,254,886 | 3/1981 | Van Duren | 220/67 |

FOREIGN PATENT DOCUMENTS

| | | |
|---|---|---|
| 907027 | 1/1946 | France . |
| 2535687 | 5/1984 | France . |

*Primary Examiner*—Joseph Man-Fu Moy
*Attorney, Agent, or Firm*—Young & Thompson

[57] ABSTRACT

A method of manufacturing hollow metal sheet containers and the containers produced thereby, comprising forming an annular edge roll extending radially outward at the upper end of the container, and folding the upper end outwardly so as to form an external pocket in which the edge roll is disposed. The ends of a flexible handle are inserted into this pocket at opposite sides of the container. This pocket is shaped to form an upper hollow reinforcement rim having an upwardly concave recess to receive a lid rim. The sheet metal container thereby produced comprises a partially hollow locking rim projecting outward and integral with the side wall of the container body and formed by at least three folded sections. The rim has retaining lips projecting radially inwards for the retention of the periphery of a lid on the container. These lips are bent in from a double thickness of the sheet material, the outer side of the upwardly concave recess, between those lips, being in the form of upstanding partial cylindrical portions.

8 Claims, 9 Drawing Sheets

21
20
A
11
10
50

30
20
A
30
10
50
B 12
10
11

12
14
10₁
13
11

41
12
10₁
13
11

50
10₁
13
11
11

10
12
40
41
50

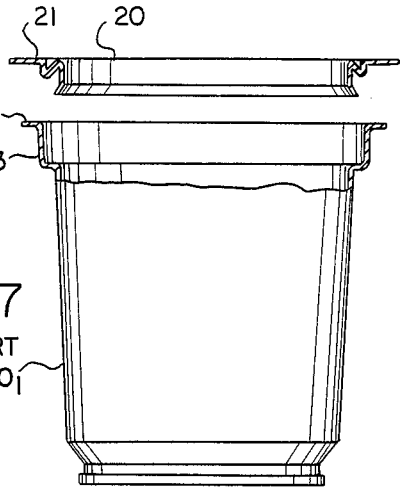
FIG. 7
PRIOR ART
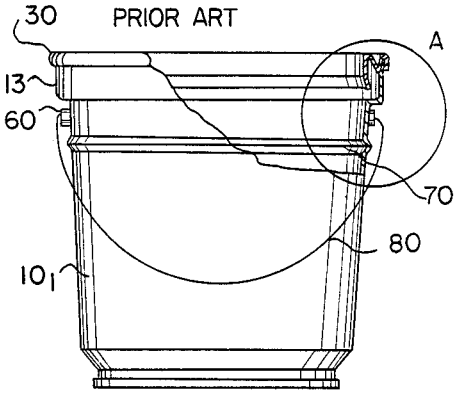
FIG. 8
PRIOR ART
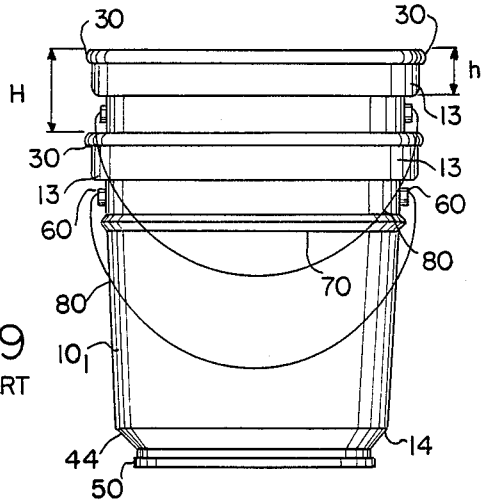
FIG. 9
PRIOR ART
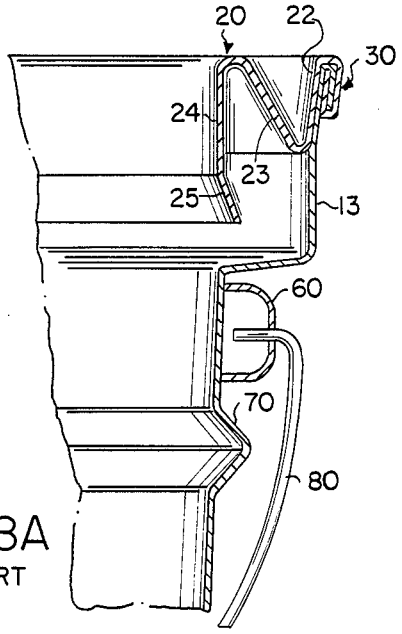
FIG. 8A
PRIOR ART
FIG. 1A
PRIOR ART
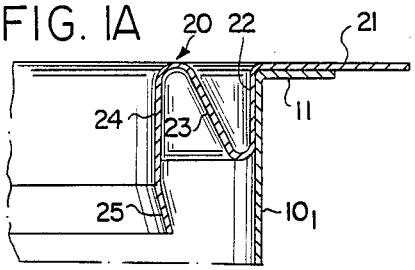
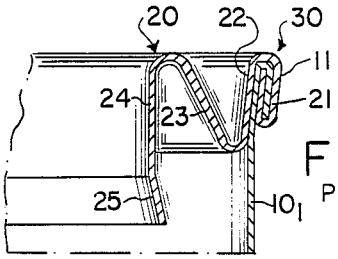
FIG. 2A
PRIOR ART

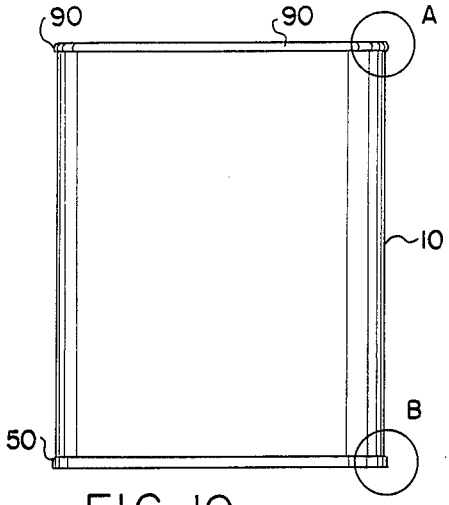
FIG. 10
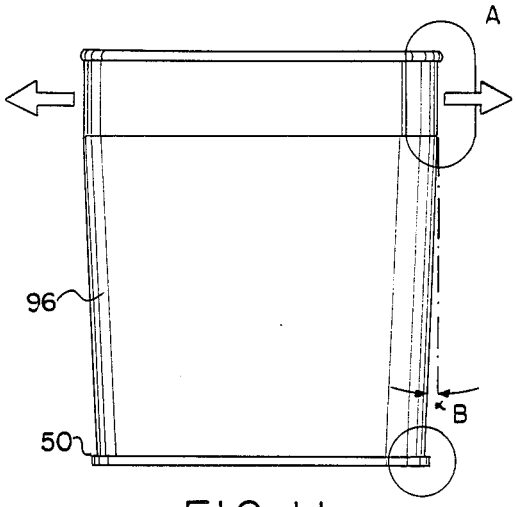
FIG. 11
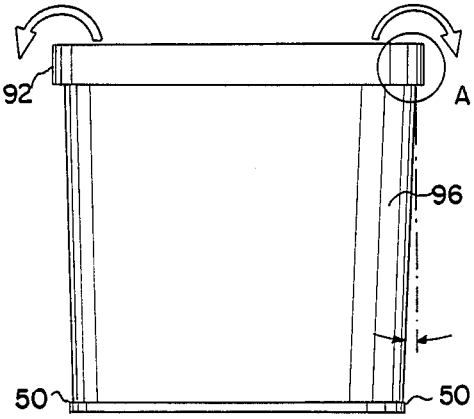
FIG. 12
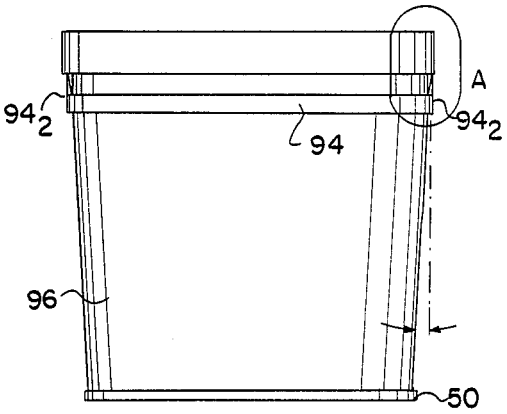
FIG. 13
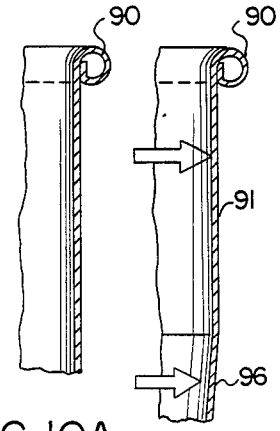
FIG. 10A
FIG. 11A
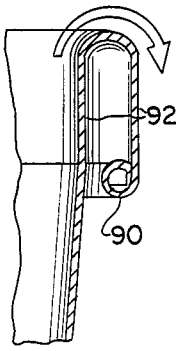
FIG. 12A
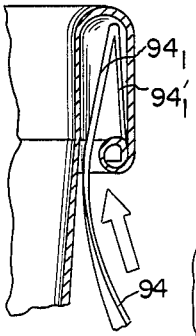
FIG. 13A
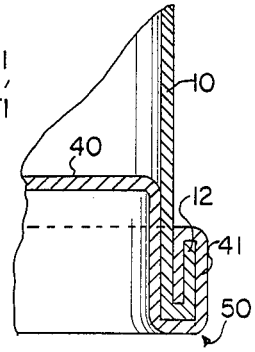
FIG. 10-11B

METHOD OF MANUFACTURING HOLLOW SHEET METAL CONTAINERS AND CONTAINERS PRODUCED THEREBY

This invention relates to the manufacture of sheet metal-walled containers and the containers that result.

This invention gives rise to some economic and technical advantages if compared with the procedures and conventional containers already known. It also gives rise to some advantages which are already known in part, for they are obtained in other recent procedures which suppress the internal locking rings obtained independently which rings are usually secured later to the side walls of the main body, with these locking rings providing the means for the cover to mate with the container mouth. Instead of this conventional process, the present procedure uses the same side walls of the body of this container for achieving the closing effect.

The present invention offers numerous advantages which are even more important. Not only is the number of stages or phases of production reduced, but also less expensive production methods in comparison with the highly mechanized production methods of current use, can be used. Thus the present invention provides a method of producing containers comprising a flexible handle integral with the container, without having to resort to side pieces or conventional lugs for articulating the two ends of a known metal handle, normally of the rigid type, fitted to a conventional container.

The bottom of the container is fitted to the side wall of the container during the initial production stages, thereby avoiding the turning operations in the course of production. This, in turn, shortens the operations and phases of production.

As well as the advantages due to the lower production cost of the containers, the advantages of the actual containers obtained through this invention must be mentioned. These advantages could be outlined by the following points:

A. By providing a peripheral locking bead extending radially outwardly with respect to the main body of the container and the mouth of this container, the retention of the contents of the container is avoided when the container is emptied. This is especially important when dealing with more or less viscous products.

B. A high degree of rigidity is provided in the area where the container closing action occurs and where the cover must be fitted. In practice, this means an improvement in the good closing and airtightness of the container under normal conditions.

C. In the course of manufacturing cylindrical and truncated conical stackable containers, the vertical space or height which is usually lost in placing the internal locking ring is reduced to a minimum. Above all, as a completely new effect, a good part of the vertical space lost in placing the articulation lugs of the conventional metal handles is reduced. This gives rise to more efficient storage of such containers which can be stacked under normal conditions.

D. The suppression of the lugs means more efficient storage without the danger of scratching the surface paint of the containers along their sides.

E. The suppression of the known metal handles allows an even greater increase in this storage capacity, for the handles used do not protrude from the container, which is a feature not found in conventional containers fitted with articulated metal handles on side lugs.

F. With the peripheral locking bead on the outside of the side walls of the container, it is possible to obtain a very rigid and strong support surface to help with the raising of the cover by means of a conventional tool.

G. The possibility of obtaining containers fitted with flexible handles so that the two opposite ends of this handle are secured to and incorporated in the peripheral locking bead which is part of the side walls of the container is of special interest for containers which contain heavy loads; the flexible handle adapts much better to transporting and is much easier to handle for the user. Moreover, these flexible handles are made of strips of a certain width which means that the specific pressure on the end holding the container is less than the pressure exerted by the normal handles. This represents a great convenience in transporting for the user.

All these advantages and others which can be deduced from the very nature of the invention will become apparent in the following detailed description with reference to the attached figures, in which:

FIGS. 1 and 2 as well as the details which appear in FIGS. 1A, 2A 2B illustrate stages of the manufacture and details of the joint of a conventional sheet metal cylindrical container with an end provided with a detachable sealing ring which has been fitted on the inner side of the container opening.

FIGS. 3, 4, 5, 6, 7 and 8 and the details of FIG. 8A show the main stages of a known process of manufacture of a conventional stackable truncated conical container and the detail of this container.

FIG. 9 shows two conventional truncated conical containers which have been produced according to the stages of manufacture shown in FIGS. 3 to 8; and FIGS. 10, 11, 12, 13, 14, 15 and 16, and FIGS. 10A, 10B, 11B, 14A, 15A, 16A and 16B showing details, show the main stages of manufacture of stackable truncated conical containers with flexible handle attachments, according to the present invention and several structural details of said containers, according to an advantageous method of application or execution of the present invention.

FIG. 21 shows a cross section of a truncated conical container with cover adapter, while

Figures 1, 2, 2B, 3, 4, 5, 6:
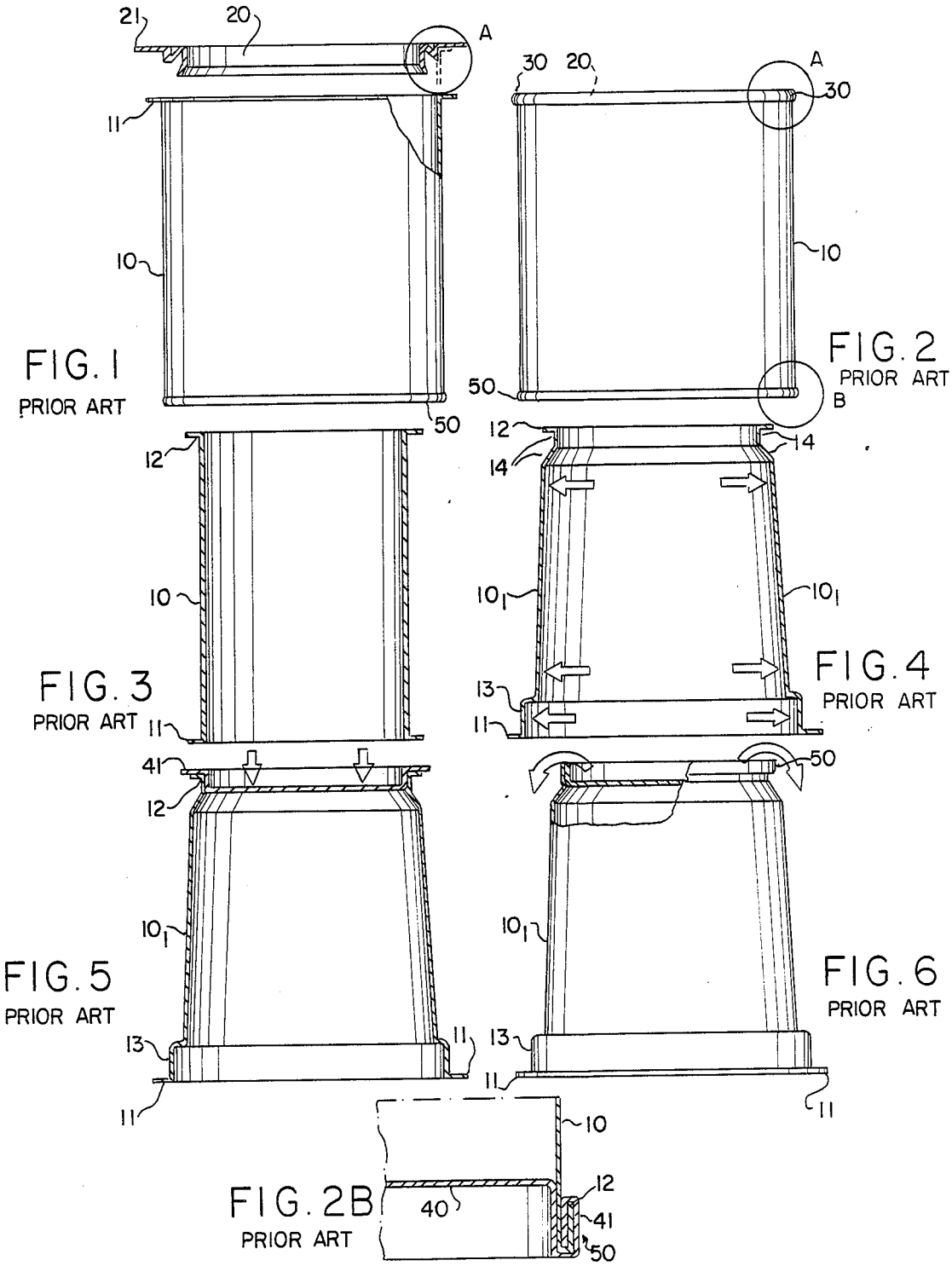
FIG. 1 PRIOR ART
FIG. 2 PRIOR ART
FIG. 3 PRIOR ART
FIG. 4 PRIOR ART
FIG. 5 PRIOR ART
FIG. 6 PRIOR ART
FIG. 2B PRIOR ART
Figure 14:
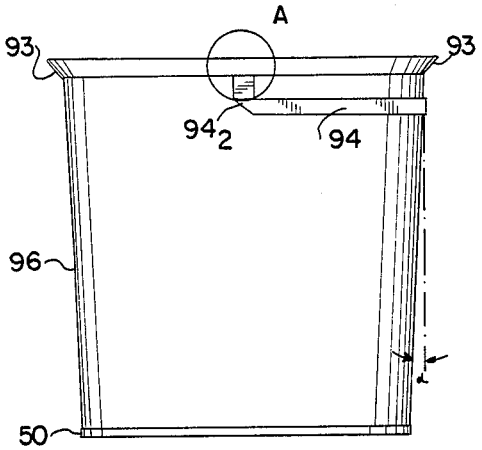
Figure 15:
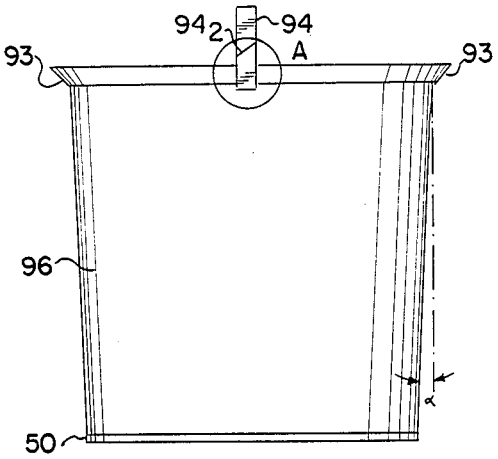

Referring to FIGS. 1 to 9, a great many of the previous hollow sheet metal containers were produced by means of the coupling of a hollow body 10 made out of sheet metal welded using for example an electrical generator, which container is cylindrical at least in the initial manufacturing facturing stages (FIGS. 1 and 3) with a sheet metal detachable ring made independently from the hollow body 10 (FIGS. 1–7) in such a way that, at a certain stage of the manufacturing process, the ring 20 and body 10 are coupled (FIGS. 1A and 2A) by folding the protruding flanges of both elements 11 and 21 in order to form a peripheral coupling edge roll 30 between both elements. The procedure, therefore, is similar to that of the coupling of the base 40 (FIG. 2B) with respect to the metal sheet side walls of the body 20, using lowermost peripheral flanges 12 and 41, similar to flanges 11, which are folded peripherally of the base in order to make the peripheral edge roll 50 of the base 40.

The detachable ring 20 generally has folded flange portions 22, 23, 24 and 25 on its inside which secure the lid (not shown) into the peripheral spaces provided by said folded portions, thus enabling the airtight closure of the container at its upper end. It should be noticed that, once that coupling between both elements 10 and 20 is achieved the portion 22 which remains at a slight angle (FIG. 2A) constitutes, together with the edge roll 30, the elements which allow the container to be easily opened by exerting the right amount of pressure on a point on the lid while it is levered open by an instrument which engages the same peripheral edge roll 30. With regard to the manufacture of truncated conical containers, which must also be easily stackable, the assembly and coupling of this detachable ring 20 poses other problems as, being joined to the container by its inside, it makes the widening of the original hollow body necessary to enable stacking of containers or to enable one container to pass through the upper opening of another container.

FIGS. 3, 4, 5, 6 and 7 show the possible principal stages of manufacture of cans or containers of this sort which need to be widened. End elements 14 and 13 joined to form the cone body 10 (FIG. 4); the assembly of the base 40 (FIG. 5); the formation of the edge roll 50 of the base 40 (FIG. 6), and the inversion of the container so as to arrive in the position depicted in FIGS. 7 and 8 in which the detachable sealing ring 20 is assembled and, in FIG. 8, fixed to the container. Depending on the type of container described, the provision and assembly of the lugs 60 still remains, and the peripheral stop rim 70 is still to be made; also the flexible handle 80 is still to be assembled in order to obtain the type of stackable container depicted in FIG. 8 and detailed in FIG. 8A. Apart from the operations which have been shown to be necessary, it will be understood, especially from FIG. 9, that when two containers like those shown in FIG. 8 are stacked, vertical heights or spaces 'H' determine the separation between two axially successive containers. Said separation depends, as can be seen, on the height 'h' and on the space necessary for the assembly of the lugs 60 for the flexible handle 80. Obviously, the less the vertical distance 'H' the greater the number of containers which under equal conditions of sizes and surfaces can be stored.

These preliminary explanations about the features and difficulties resulting from the usual methods of container manufacture having been given, it will be possible more readily to appreciate a practical example of the improvements of the present invention applied to the construction of stackable, truncated conical sheet metal containers, which have also been provided with a special handle making the application and securement of the conventional lugs of the conventional handle unnecessary.

As will be appreciated, the fact that we refer to this preferred embodiment of manufacture, which is much more complex, does not presuppose that these same improvements cannot be applied to other simpler cases like the manufacture of cylindrical non-stackable containers, fitted or not fitted with the sort of flexible handle which is fastened during, and as a result of, the formation of the upper, outer peripheral sealing rim formed from the actual metal walls of the original hollow cylindrical body and welded by means of an electrical generator.

Referring now to FIGS. 10 to 16, the present improvements consists essentially in the elimination of the conventional detachable metallic ring 20 which is made separately from the main body 10. Instead, only the actual sheet metal of the peripheral wall of the body 10 of the container is used, and with certain outer folding operations is turned into a 'pocket' 92 (FIG. 12A); the making of this 'pocket' is followed by the external peripheral shaping of this upper folded zone or 'pocket' 92 (FIGS. 14A–15A) until it becomes a peripheral rim somewhat similar to that of the eliminated detachable ring 20, remaining however integral with the metal sheet wall of the container body 10. The external peripheral rim 93 (corresponding to the eliminated ring 20) therefore remains integral with the body 10 of the container, and is situated on the outer periphery of the container due to the external folding of the 'pocket' 92 and the external shapings executed in the afore-mentioned operations. Therefore, apart from eliminating the costs of manufacture of a detachable ring 20 and the cost of the subsequent fitting of said detachable ring to the main body 10 of the container, said upper rolled metal peripheral shape 93 integral with and forming an external part of the body 10 allows pourable contents of the container, which are more or less viscous, to be poured out more easily than would occur in the case of a conventional container fitted with a detachable ring 20 fixed to the inside walls of the body 10 of a container.

To minimize the work of folding the 'pocket' 92 it will be convenient to form (as shown in FIGS. 10 and 10A) an initial upper peripheral edge roll 90 and an upper cylindrical zone 91 which is important for the manufacture of truncated, conical containers (FIG. 11).

In this embodiment, the cylindrical container 10 of FIG. 10 is expanded, provided with a conventional bottom 40 which is joined to the walls of the body 10 by means of a lower edge roll 41 (FIGS. 10B–11B) to obtain a structure like the one shown in FIGS. 11 and 11A having an upper peripheral edge roll 90, a cylindrical zone 91 (from which a 'pocket' 92 is made) and a lower truncated conical zone 96 obtained by the expansion or deformation shown by the two opposing arrows in FIG. 11, said lower truncated conical zone 96 having a slant or convergence angle $\alpha$.

If a container with a special handle is required, then at the time the 'pocket' 92 is made, and taking advantage of its existence (FIGS. 13 and 13A), one can insert into the 'pocket' and on opposite sides of the container, the two ends $94_2$ of a resistant, but at the same time bendable, band or strip 94, for example by bending the ends $94_2$ at 90° (FIGS. 14 and 16) which form a salient edge $94_1$ at 45° on each side of the two opposite points of connection of the band 94.

Figure 14A:
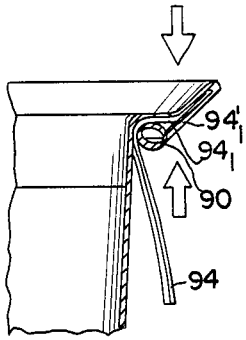
Figure 15A:
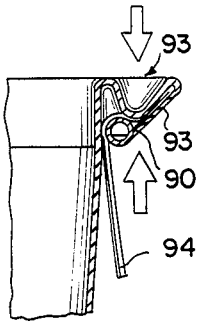

In order to improve the retention of said ends $94_2$it is convenient that they both be fitted with retaining means, for example with a lance head $94_1$, $94_1'$, (FIG. 13A) which, once inserted in the hollow of the 'pocket' 92, may not be easily extracted from the inside of the pocket, while the shaping of the outer peripheral rim 93 should be carried out as shown in FIGS. 14A and 15A.

Figure 16:
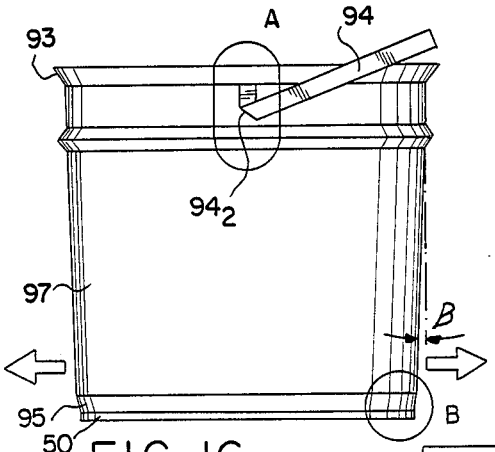
Figure 16B:
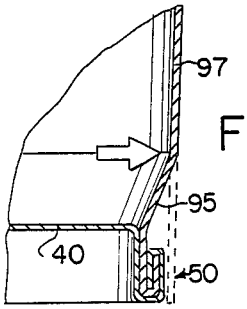

Finally, in order to make the container stackable, its depth should be reduced, in this case, by slightly expanding the lower zone 95 of the container progressively in an upward direction so as to obtain truncated conical walls 97 having a small angle $\beta$ as shown in FIG. 16 and 16B.

Figure 16A:
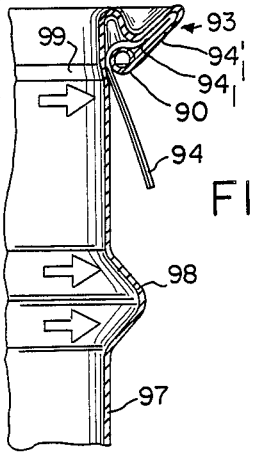

At the same time, the outer stop or protuberance 98 is made (FIGS. 16A) which will be used to limit the insertion of one container into another when axial stacking takes place.

From the foregoing description, will be seen the steps which must be carried out to obtain the truncated conical container which appears in FIG. 16, and which comprises an external and integral peripheral rim 93, which replaces the conventional ring and allows perfect fitting and closure of the container's lid (which is not shown so as to avoid complicating the drawings unnecessarily). It may be convenient, at the same time as the external stop or protuberance 98 is made, to widen slightly the walls of the container in the zone 99 (FIG. 16A) so as to aid, on the one hand, the retention of the edge protuberance integral with the outer peripheral rim 93, and on the other hand the flexible adaptation of the edges of the lid against the zone 99 ensuring in this way the airtight and firm closing of said lid.

Figure 17:
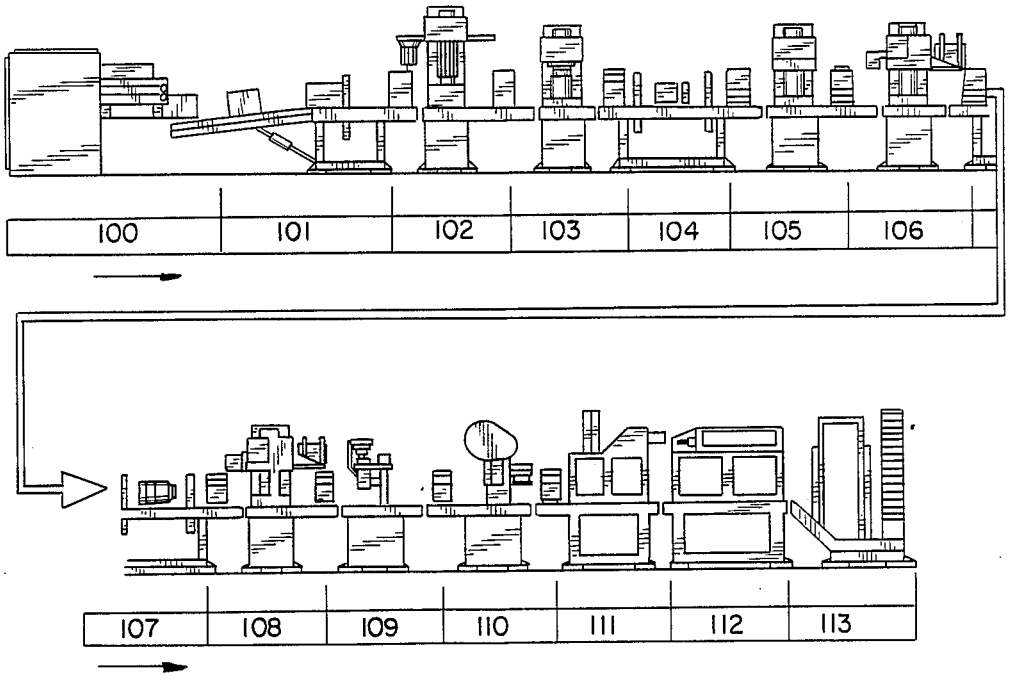
FIGS. 17 and 18 show diagrammatically the main stages of manufacture of stackable, truncated conical containers according to a conventional method and according to the method of the present invention, respectively.
Figure 18:
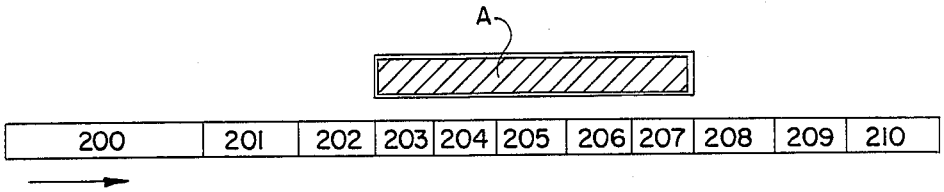

To understand better the improvements of the present invention there is next illustrated a conventional production line for hollow truncated stackable sheet metal containers and the differences between the previous line and that required for carrying out the present invention. In particular, the reduction in manufacturing stages achieved by the present invention will be shown. FIGS. 17 and 18 show two diagrams, the aim of which is to show in a graphical and direct way the elimination or replacement of certain stages of manufacture and the possibility of using much simpler mechanical methods for the construction of hollow sheet metal containers, and in this exemplary case, of truncated conical hollow containers fitted with handles. The conventional production line would comprise, according to FIG. 17:

(a) The production of a hollow cylinder welded at stage 100.

(b) The placing of a container in a vertical position in stage 101.

(c) The shaping into frusto-conical form of the cylinder in the expansion stage 102.

(d) The rimming and construction of edge rims in stage 103.

(e) Tipping in stage 104.

(f) Rimming and the reduction of the depth by expansion in stage 105.

(g) Fitting the bottom by means of a closing mechanism in stage 106.

(h) Another tipping step in stage 107.

(i) Assembly of the detachable ring on the upper opening in the closing stage 108.

(j) Welding of the side lugs of the handle in stage 109.

(k) Assembly of the handle with a handle manufacturing and fitting machine in stage 110.

(l) Varnishing in stage 111.

(m) Oven drying in stage 112.

(n) Stacking in stage 113.

According to the present invention the production line and operations are very different, as depicted in FIG. 18:

(a) Stage 200 is equivalent to Stage 100 of FIG. 17.

(b) Stage 201: rimming and making the initial upper peripheral edge roll 90.

(c) Stage 202: fitting the bottom. It should be noted that the fact that the bottom is fitted during the initial stages of the process is a significant feature of the improved process of the present invention, as this reduces the number of operations necessary and allows the use of simpler and cheaper machinery.

(d) Stage 203: positioning of the container.

(e) Stage 204: shaping the container into frustoconical form.

(f) Stage 205: making the 'pocket' 92 and assembly of the handle 94.

(g) Stage 206: forming the integrate external rim 93.

(h) Stage 207: reducing the depth by slightly expanding the lower zone 95 and forming protuberance 98 and if necessary a retentive expansion zone 99.

(i) Stages 208, 209, 210. These are equivalent to the finishing steps shown in Stages 111, 112 and 113 of the conventional process of FIG. 17.

Figure 19:
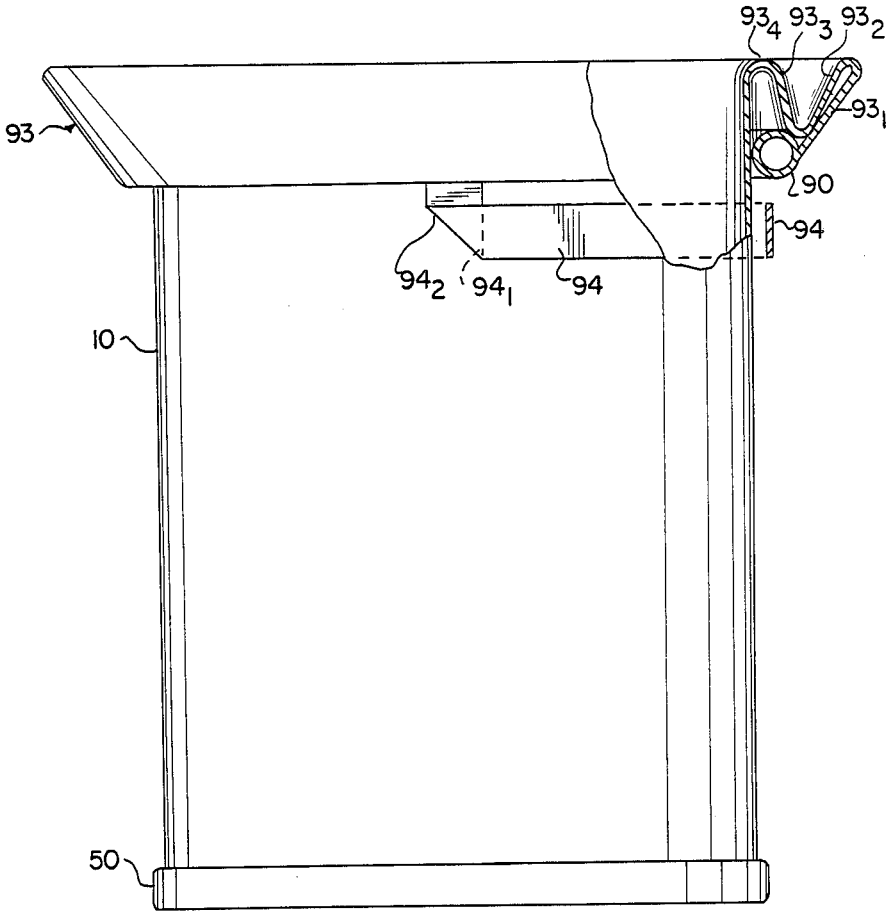
FIGS. 19 and 20 show respectively two containers according to the present invention, one being cylindrical and the other a stackable truncated conical container.

From the foregoing description it will be appreciated that the number of stages necessary, due to the present improvements, is far smaller than in an automatic conventional production line process. Also, the improved process allows the use of simpler and cheaper methods. The group of operations marked by the letter "A" in FIG. 18 can be carried out with an eccentric press, specially adapted in the form of a 'transfer' which is very effective and cheap in comparison with the methods normally used in conventional automatic production lines for containers. According to these improvements, hollow sheet metal containers are made having a peripheral rim 93, represented on a somewhat larger scale with respect to the body 10 in FIGS. 19 and 20, and which is made (FIG. 19) by folding outwardly the upper zone of the side wall of the body 10 of said sheet metal container, forming an upper peripheral fold 90 facing outward and downward, forming a 'pocket' 92, and then pressing and shaping said upper peripheral fold in order to obtain a hollow peripheral reinforcement and support rim 93 comprised by at least three foldesd sections $93_1$, $93_2$ and $93_3$ (FIG. 19) preferably inclined, and arranged around the remainder of the unitary side wall of the body 10 of the container; in this way, said hollow rim is formed around the upper peripheral curved rim $93_4$ of the container where the conventional lid is to be fitted.

Figure 20:
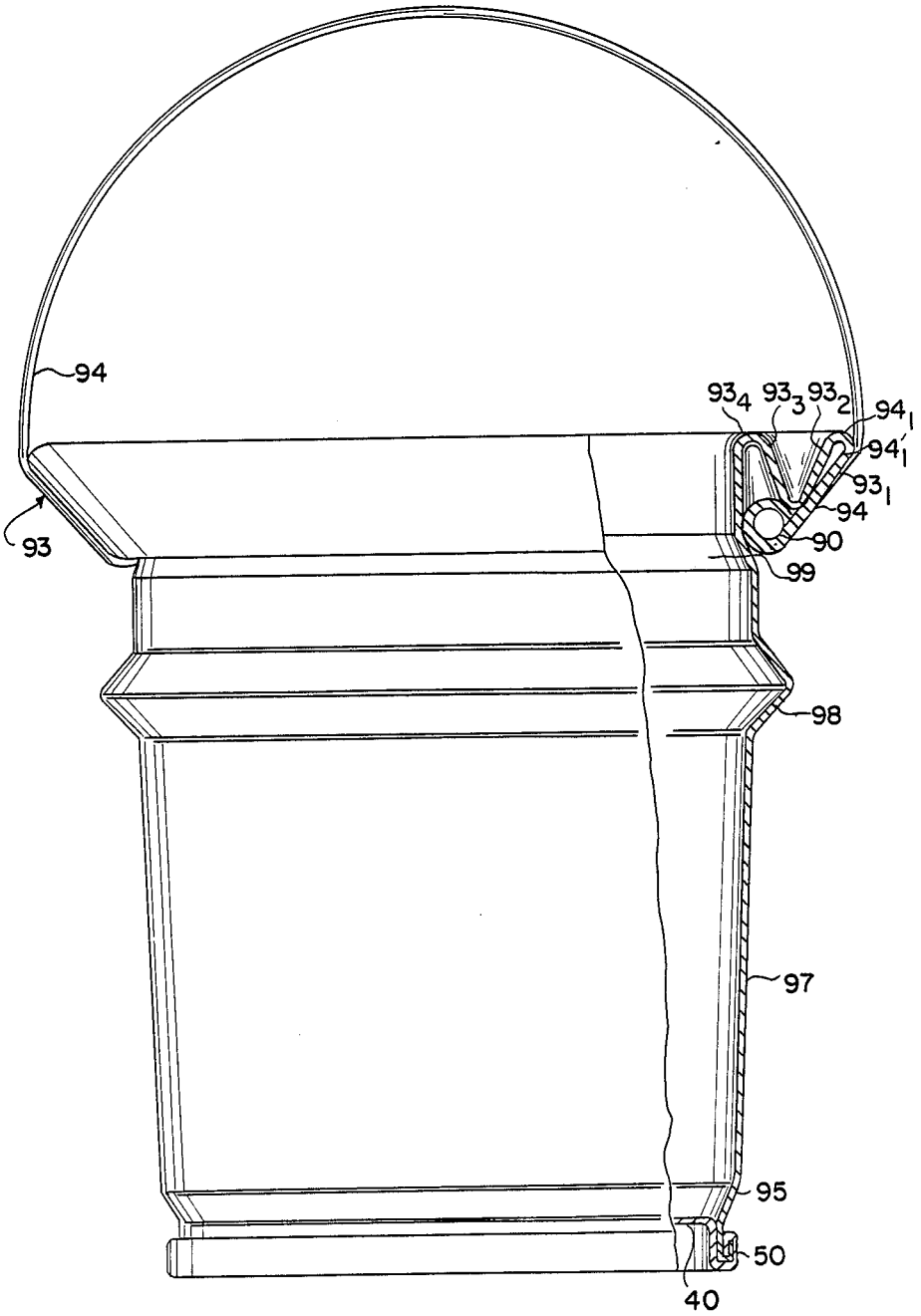
Figure 21:
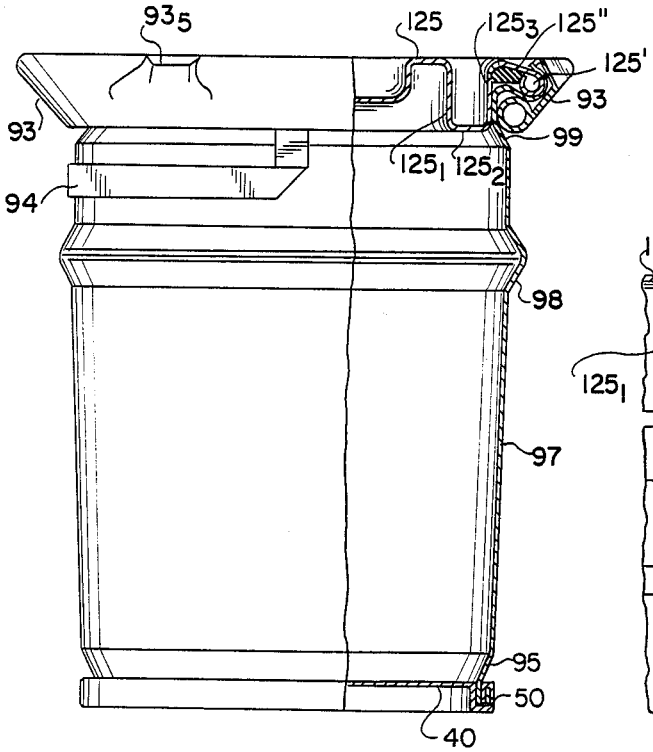
Figure 23:
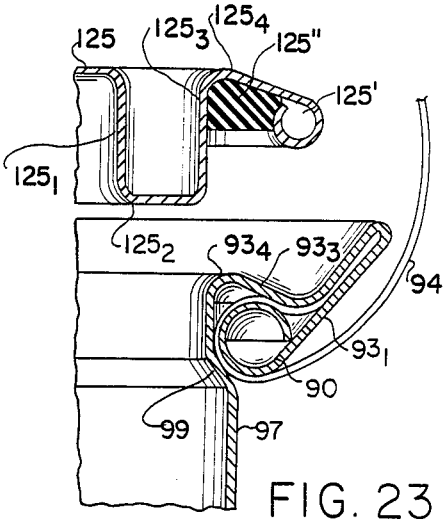
FIGS. 23 and 24 are both details drawn on a larger scale of the cover coupling and retaining areas.

In FIG. 20, the same three folded sections $93_1$, $93_2$ and $93_3$ are shown, which are disposed externally around the curved peripheral rim $93_4$. Also, featured in this type of truncated conical container are the peripheral stop protuberance 98; the truncated conical walls 97; the depth reduction zone 95; the bottom 40 and the lower edge roll 50, as well as the expanded zone 99. The zone 99 is used to improve the fit of the inner ridge of the lid (not shown in the diagram) to the hollow container, as well as to improve the fit of the initial edge roll 90 for making the 'pocket' 92 and ultimately the production of the external peripheral rim 93.

In these figures one can also see the flexible integral handle 94 with its articulated end sections $94_2$.

Although FIGS. 10 to 16 show the stages of manufacturing a stackable truncated conical container, it will be understood that the inventive method can be used to make any form of annular container, e.g. cylindrical, of less complicated design (possibly without handles) and not necessarily stackable.

Figure 22:
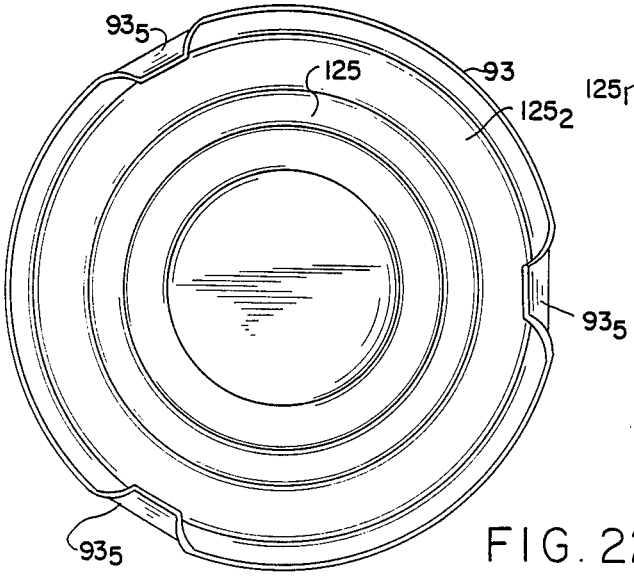
FIG. 22 is a plan view of this container with its cover.
Figure 24:
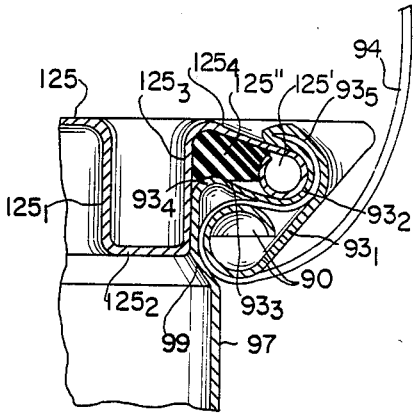

As can be seen in FIGS. 21, 22, 23 and 24, the container may consist of a conventional truncated conical hollow body 97 of thin sheet metal fitted with a base 40 and a lower rolled edge 50 as well as a protuberance 98 to act as a buffer for stacking plural containers. This container has a reinforcing and locking peripheral rim 93 projecting outwardly and integral with the sheet metal side wall 97 of the container body, said rim consisting of at least three folds or bent portions $93_1$, $93_2$ and $93_3$, with the particular feature that, on the upper periphery and outermost part of said rim there are, as seen in FIG. 22, at least two retaining folds $93_5$ projecting radially inwardly and consisting of slightly elastic and flexible lips which coact with the peripheral overhang 125' of the lid 125 so as to ensure strong retention of said lid once it has been coupled with said outer reinforcing rim 93.

The folds or bent portions $93_1$, $93_2$ and $93_3$ of the outer peripheral rim 93 are coaxial with the side wall of the container, said rim 93 extending around the peripheral edge $93_4$ of the container mouth, said edge $93_4$ having a diameter which is smaller than the diameter of said rim 93, and the first innermost fold $93_3$ of said rim extending radially outwardly of edge $93_4$ with the particular feature that said outer locking rim 93 constitutes a hollow peripheral support and reinforcing bead which surrounds, abuts, and reinforces the peripheral edge $93_4$ of the container mouth. One or more of said folds $93_1$, $93_2$ and $93_3$ forming the outer reinforcing rim are such that on or in these folds complementary folds $125_3$, $125_4$ and 125' of the lid are so shaped that, once the lid 125 is fitted to the container, said flexible and elastic lips $93_5$ folded radially inward but radially outside the circumference of said inner edge $93_4$ ensure the retention of the peripheral overhang 125' of the lid once, due to pressure, this overhang 125' has secured beneath the mentioned retaining areas or lips $93_5$.

The lower free end of the outermost fold or overhang $93_1$ of said rim is formed by a reinforcing edge roll 90 resting on the outside wall of the container, abutting a peripheral tapered zone 99, while the free end of the innermost fold or overhang $93_3$of said rim 93 is connected with the upper peripheral edge $93_4$ of the container mouth to which the lid 125 has to be fitted, so that the upper and most external overhang of said rim 93, as well as that portion of the lid against which the lips $93_5$ bear, constitute strong support surfaces for any instrument that may be used in removing, by leverage, the cover of the container after lips $93_5$ have been opened.

The radially inward folded retaining lips $93_5$ of the rim are dimensioned so that the overhang or rolled edge 125' of the lid 125 has to bend them down so as to clear them when the lid is pressed against the container mouth for hermetic sealing.

The flexible retaining lips $93_5$ have a slightly rounded contour so as to allow the passage of the overhang or rolled edge 125' of the lid 125 whe closing the container.

The at least partly hollow area constituted by the outer peripheral rim 93 is used advantageously to secure on the inside, in diametrally opposed positions, the two opposite ends of the flexible medium, as for example a resilient strap 94 which, on folding the sheet metal to form said outer peripheral rim 93, is securely retained, so that said flexible medium 94 coupled to the container serves as a handle for the container.

To improve the closing and airtightness of the container, it may be advisable to provide the lid with an internal strip of rubber or elastic material 125'', which can act as a seal when the lid is pressed against the edge $93_4$ of the mouth. Bent portion $93_2$ can also be provided with a similar strip 125'''.

Figure 25:
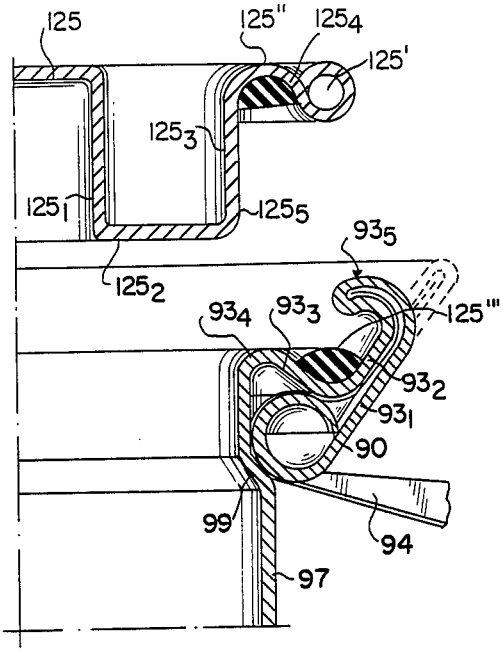
FIGS. 25, 26, 27 and 28 show several details of similar container according to the present invention, with the peripheral outer rim adapted to improve the cover coupling and retention.
Figure 26:
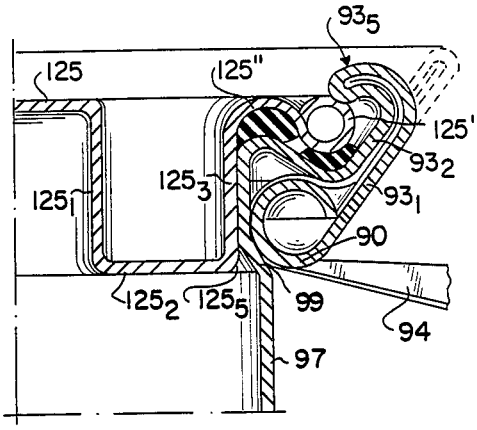

As can be seen in FIGS. 25 and 26, retaining lips $93_5$ are folded from the external peripheral portion of the hollow reinforced container rim 93 so that the peripheral overhang 125' of the lid 125 can clear said retaining lips $93_5$ and be retained under these lips $93_5$ which are uniformly distributed about the circumference of the container rim 93.

Figure 27:
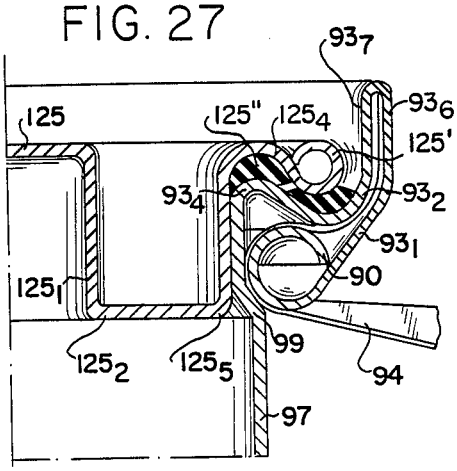
Figure 28:
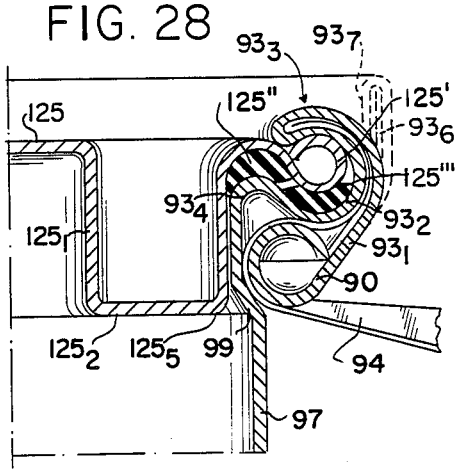

The retention effect will be increased by folding the lips $93_5$ after the lid 125 is mounted on the container (FIGS. 27 and 28). If the peripheral overhang 125' is provided with an outwardly rolled edge it is possible to adapt closely the shape of every arcuate lip $93_5$ (FIG. 28) to this outwardly rolled edge, thereby to assure an increased hooking retention of the lid 125.

It is also advisable to give a cylindrical shape to the top and external portion of the rim (FIG. 27) by means of the folds $93_6$ and $93_7$. This cylindrical portion $93_6$ and $93_7$ avoids a linear and unstable contact between two axially stacked containers.

What is claimed is:

1. A sheet metal container having a vertical axis and having side walls that terminate downwardly in a closed bottom and that extend upwardly toward an open top and an upper peripheral rim integral with said side walls of the container at said top, said rim comprising at least three annular folded sections, said sections being interconnected by annular curved portions, said rim being further connected with said side walls by a further annular curved portion, a first of said at least three sections extending from said further annular curved portion at a downward incline away from said axis and being joined by one of said annular curved portions to a second of said at least three sections which is inclined upwardly away from said axis and terminates in another of said annular curved portions from which a third of said at least three sections is inclined downwardly toward said axis, said first and second sections forming a central upwardly opening hollow region between them.

2. A container according to claim 1, said second and third sections being bent inwardly at at least two spaced locations about the periphery of the rim thereby to form retaining lips for the retention of a lid.

3. A container according to claim 2, and a lid having a rim received in said upwardly opening hollow region and retained therein by said lips.

4. A container according to claim 1, said third section terminating downwardly in an edge roll disposed between said third section and said side walls.

5. A container according to claim 4, said side walls adjacent said rim having an annular outwardly and upwardly opening recess within which said edge roll nests.

6. A container according to claim 1, and a resilient strap having opposite ends secured in diametrically opposed positions inside said rim so as to form a handle.

7. A container according to claim 6, said strap ends being bent back on the strap, said bent back ends being disposed entirely within said rim to resist dislodgement of said strap ends from said rim.

8. A container according to claim 1, said third section terminating downwardly in an edge roll disposed between said third section and said side walls, and a resilient strap having opposite ends secured in diametrically opposed positions inside said rim and extending between said edge roll and said side walls and terminating between said second and third sections, thereby to provide a handle for the container.

* * * * *

UNITED STATES PATENT AND TRADEMARK OFFICE

CERTIFICATE OF CORRECTION

PATENT NO. : 4,742,932

DATED : May 10, 1988

INVENTOR(S) : Pedro PLANAS PEDRAGOSA

It is certified that error appears in the above—identified patent and that said Letters Patent is hereby corrected as shown below:

ON THE TITLE PAGE, ITEM [19] change "Pedragosa" to --Planas Pedragosa--; and in Item [76] Inventor: change "Pedro P. Pedragosa" to --Pedro Planas Pedragosa--.

Signed and Sealed this

Thirtieth Day of August, 1988

*Attest:*

*Attesting Officer*

DONALD J. QUIGG

*Commissioner of Patents and Trademarks*